United States Patent [19]

Kolobnev et al.

[11] 4,038,072

[45] July 26, 1977

[54] ALUMINUM-BASE ALLOY

[76] Inventors: Ivan Filippovich Kolobnev, 1 Spaso-Nalivkovsky pereulok, 19, kv. 12; Georgy Yakovlevich Mishin, 1 Institutsky proezd, 8, kv. 35, both of Moscow, U.S.S.R.

[21] Appl. No.: 574,459

[22] Filed: May 5, 1975

[51] Int. Cl.[2] ..... C22C 21/16

[52] U.S. Cl. ..... 75/142; 148/32

[58] Field of Search ..... 75/142, 143, 144, 147, 75/148; 148/32, 32.5

[56] References Cited

U.S. PATENT DOCUMENTS

| | | | |
|---|---|---|---|
| 3,615,371 | 10/1971 | Nakajima et al. | 75/142 |
| 3,773,501 | 11/1973 | Nakajima et al. | 75/142 |

*Primary Examiner*—R. Dean

[57] ABSTRACT

An aluminum-base alloy which comprises, wt.%: cerium, from 4.0 to 6.0; copper, from 2.0 to 4.0; silicon, from 1.0 to 3.0; manganese, from 0.7 to 2.0; zirconium, from 0.05 to 0.5; and magnesium, from 0.1 to 0.3. The alloy may additionally contain from 0.2 to 0.7 wt.% of antimony and/or from 0.25 to 0.5 wt.% of nickel.

The proposed alloy exhibits improved high-temperature strength and tightness and is employed for casting components of combustion equipment.

5 Claims, No Drawings

ALUMINUM-BASE ALLOY

BACKGROUND OF THE INVENTION

The present invention relates to aluminum-base alloys which may be employed for manufacturing air-conditioning units, components of thermal equipment and other items exposed to high temperatures in their operating environment.

The alloy of this invention combines excellent high-temperature resistance and tightness with good processability.

It can be most advantageously employed for manufacturing intricately shaped structual components, such as heat-exchanger housings exposed to elevated internal pressures of liquid or gaseous media and to high temperature, on the order of 400° C.

It is known in the art to employ aluminum-base alloys (German Pat. No. 479,5f28) one of which comprises, wt.%: from 3 to 12 cerium and from 2 to 20 copper, while another from 2 to 12 cerium and from 1 to 8 silicon, as well as solid solution-forming constituents such as magnesium and zinc or high-melting elements such as titanium, molybdenum and tungsten.

The foregoing patent claims that said alloys display improved mechanical properties.

However, aluminum-base alloys containing copper, cerium and silicon in the specified amounts cannot have adequately high processing and mechanical properties.

Thus, the 20-wt.% copper and 12-wt.% cerium levels reduce the plasticity of the alloy and detract from its corrosion resistance.

There also exists an aluminum-base alloy ("Metal Progress" Journal, vol. 61, No. 6, pp. 162–6, 1952, U.S.A.) which has an unstable chemical composition (since the misch metal is a waste product of uranium production).

For this reason, the latter known alloy shows inadequate mechanical properties (ultimate strength, from 9.0 to 13.0 O kg/sqmm.; percentage elongation, from 0.5 to 1.5).

It is likewise known in the art to employ an aluminum-base alloy comprising, wt.%: misch metal, from 8.5 to 10.0; copper, from 1.5 to 2.0; silicon, from 1.2 to 2.2; manganese, from 0.7 to 0.9; chromium, from 0.1 to 0.3; titanium, from 0.1 to 0.2; zirconium, from 0.1 to 0.3; and iron, from 1.0 to 2.0. The latter alloy is also found wanting as far as its mechanical properties are concerned (ultimate strength, from 12.0 to 14.0 kg/sq.mm.; percentage elongation, from 0.8 to 2.0)

The foregoing alloys have not found industrial application for manufacturing mold castings designed to operate at high temperatures and pressures because their mechanical properties fall short of meeting modern requirements.

Currently, there is a need for aluminum-base alloys with improved processing properties for manufacturing air-conditioning units, components of thermal equipment and other products designed to withstand high operating temperatures and pressures.

Mold casting requires improved casting properties of the alloys attainable by providing finer-grained structures thereof, which is achieved through selecting an appropriate composition of the alloy.

Additionally, the alloys designed for casting components of thermal equipment must provide a high level of tightness and high-temperature strength, for these components experience high pressures of liquid or gaseous media and high temperatures, on the order of 400° C.

Not a single prior art alloy meets all the above requirements.

OBJECTS AND SUMMARY OF THE INVENTION

It is a cardinal object of the present invention to provide an aluminum-base alloy th composition of the constituents and the ratio thereof being such as to assure improved high-temperature strength of the alloy.

A further, and no less important, object of the invention is to provide an aluminum-base alloy featuring improved casting properties.

Another object of the invention is to provide a gas- and liquid-tight alloy.

The foregoing objects are attained by the provision of an aluminum-base alloy comprisng cerium, copper, silicon, manganese and zirconium, which, in accordance with the invention, additionally comprises magnesium and wherein said components are present in the following amounts, wt.%:

cerium, from 4.0 to 6.0
copper, from 2.0 to 4.0
silicon, from 1.0 to 3.0
manganese, from 0.7 to 2.0
zirconium, from 0.05 to 0.5
magnesium, from 0.1 to 0.3, aluminum and admixtures being the balance.

The alloy of this invention has sufficiently high casting properties fitting it for producing mold castings of intricate configuration.

It has been found that addition of cerium, copper and silicon in amounts conducive to the formation of a quarternary phase of A1CeSiCu arranged as a solid framework, makes for high continuous durability and creep strength of the alloy.

It has also been found that manganese and copper added in the specified amounts giving rise to a phase ($A1_{12}Mn_2$ Cu) which provides for microheterogeneity of the solid solution grains, assure improved mechanical properties of the alloy at temperatures of 20° C. and about 400° C.

The alloy of the proposed composition exhibits improved high-temperature strength and tightness as well as adequate casting properties.

Lower levels of the constituents of the proposed alloy would entail a reduction in its high-temperature strength.

Higher levels of the constituents of the proposed alloy would reduce its plasticity.

The alloy of this invention should preferably comprise antimony to the extent of from 0.2 to 0.7 wt.%.

The antimony component of the alloy rasies its hardness and leads it improved cutability.

The proposed alloy may optionally comprise from 0.25 to 0.5 wt.% of nickel which gives the alloy additional hardness at elevated temperatures.

The proposed alloy may likewise contain vanadium, titanium, chromium and molybdenum as admixtures whose total quantity should not exceed 0.2 wt.%.

A higher level of admixtures impairs the processability of the alloy.

DETAILED DESCRIPTION OF PREFERRED EMBODIMENTS

The present invention will be further understood from the following exemplary embodiments thereof illustrating some possible compositions of the proposed alloy.

EXAMPLE 1

The alloy was prepared in a crucible electric melting furnace.

A batch containing a specified quantity of aluminum and a predetermined amount of high-melting alloys (aluminum-silicon, aluminum-manganese and aluminum-zirconium) was charged to a preheated crucible.

Upon melting of the charge, the melt was agitated and heated to a temperature of 750° C. An aluminum-cerium alloy was added to the stock at said temperature, and the mixture was thoroughly agitated. Then the temperature was reduced to 720° C., and an aluminum-copper alloy and magnesium were added.

At a temperature of 710° C., the alloy was refined with dry manganese chloride, after which, at a temperature of 690° C, the alloy was poured into casting molds.

The resultant alloy contained, wt.%:

cerium, 5.0
copper, 2.3
silicon, 1.2
manganese, 1.0
zirconium, 0.1
magnesium, 0.2, aluminum being the balance, and titanium and vanadium constituting admixtures totaling 0.1. wt.%

The mechanical properties of the alloy at a temperature of 20° C. and at elevated temperatures (350° and 6400° C.) were as follows:

$\sigma_\beta = 17.0$ kg/sq.mm.
$\delta = 2.3\%$
$\sigma_{100}{}^{350°\ C} = 5.5$ kg/sq.mm., where (sigma) $\sigma_\beta$ is ultimate strength
(delta) $\delta$ is percentage elongation
(sigma) $\sigma_{100}{}^{\circ}$ is continuous durability at elevated temperatures.

EXAMPLE 2

In this example, the charge was prepared from the same components as in the previous example, except that antimony was added to the magnesium introduced into the charge prior to the refining step.

The smelting procedure duplicated that of Example 1.

The resultant alloy contained, wt.%:

cerium, 4.0
copper, 2.0
silicon, 1.0
manganese, 0.7
zirconium, 0.05
magnesium, 0.1
antimony, 0.2, aluminum being the balance, and vanadium and chromium being admixtures totaling 0.08 wt.%.

The mechanical properties of the alloy at a temperature of 20° C. and at elevated temperatures (350° and 400° C.) were as follows:

$\sigma_\beta = 15.0$ kg/sq.mm.
$\delta = 1.6\%$
$\sigma_{100}{}^{350°\ C} = 5.5$ kg/sq.mm.
$\sigma_{100}{}^{400°\ C} = 3.5$ kg/sq.mm.

EXAMPLE 3

In this example, the charge was prepared from the same components as in Example 1, except that nickel was added to the magnesium introduced into the charge prior to refining.

The smelting procedure duplicated that of Example 1.

The resultant alloy contained, wt.%:

cerium, 6.0
copper, 3.5
silicon, 3.0
manganese, 2.0
zirconium, 0.5
magnesium, 0.3
nickel, 0.5, aluminum being the balance, and chromium being an admixture amounting to 0.05 wt.%.

The mechanical properties of the alloy at a temperature of 20° C. and at elevated temperatures (350° and 400° C) were as follows:

$\sigma_\beta = 19.0$ kg/sq.mm.
$\delta = 1.0\%$
$\sigma_{100}{}^{350°\ C} = 6.0$ kg/sq.mm.
$\sigma_{100}{}^{400°\ C} = 3.5$ kg/sq.mm.

EXAMPLE 4

In this example, the charge was prepared from the same components as in Example 1, except that nickel and antimony were added to magnesium introduced into the charge prior to refining.

The smelting procedure duplicated that of Example 1.

The resultant alloy contained, wt.%:

cerium, 5.5
copper, 4.0
silicon, 2.0
manganese, 1.3
zirconium, 0.15
magnesium, 0.25
nickel, 0.25
antimony, 0.7, aluminum being the balance, and vanadium, titanium, chromium, and molybdenum being admixtures totaling 0.2 wt.%.

The mechanical properties of the alloy at a temperature of 20° C. and at elevated temperatures (350° and 400° C.) were as follows:

$\sigma_\beta = 18.0$ kg/sq.mm.
$\delta = 1.5\%$
$\sigma_{100}{}^{350°\ C} = 5.5$ kg/sq.mm.
$\sigma_{100}{}^{400°\ C} = 3.5$ kg/sq.mm.

EXAMPLE 5

In the example, the charge was prepared from the same components as in the previous example.

The smelting procedure duplicated that of Example 1.

The resultant alloy contained, wt.%:

cerium, 5.0
copper, 2.0
silicon, 1.0
manganese, 1.0 zirconium, 0.1
magnesium, 0.3
antimony, 0.5
nickel, 0.3, aluminum being the balance, and molybdenum, titanium and vanadium being admixtures totaling 0.18 wt.%.

The mechanical properties of the alloy at a temperature of 20° C. and at elevated temperatures (350 and 400° C.) were as follows:

$\sigma_\beta = 15.0$ kg/sq.mm.
$\delta = 1.8\%$
$\sigma_{100}^{350° C} = 5.5$ kg/sq.mm.
$\sigma_{100}^{400° C} = 3.5$ kg/sq.mm.

The proposed aluminium-base alloy largely facilitates the task of casting intricately shaped products, at the same time providing for adequate high-temperature strength and tightness thereof.

The results of tests indicate that air-conditioning units, components of thermal equipment and other items exposed to high operating temperatures (up to 400° C.) and pressures, constructed from the proposed alloy, are in no way inferior to steel products, offering the additional advantages of lighter weight and facility in manufacture.

The alloy of this invention may be employed for manufacturing components of thermal equipment, air-conditioning units, various heat exchangers, i.e., in a general case, for manufacturing items required to withstand high operating temperature (up to 400° C.) and elevated internal gas and liquid pressures.

What is claimed is:

1. An aluminum-base alloy, consisting essentially of the following elements in wt.%: cerium, from 4.0 to 6.0; copper, from 2.0 to 4.0; silicon, from 1.0 to 3.0; manganese, from 0.7 to 2.0; zirconium, from 0.05 to 0.5; and magnesium, from 0.1 to 0.3, aluminum being the balance.

2. The alloy as set forth in claim 1, further comprisng anti mony in the amount of from 0.2 to 0.7 percent by weight.

3. The alloy as set forth in claim 1, further comprising nickel in the amount of from 0.25 to 0.5 percent by weight.

4. The alloy as set forth in claim 2, further comprising nickel in the amount of from 0.25 to 0.5 percent by weight.

5. The alloy as set forth in claim 1, further comprising vanadium, titanium, chromium and molybdenum as admixtures in the cumulative amount of not greater than 0.2 percent by weight.

* * * * *